US010617901B2

(12) United States Patent
Mehr et al.

(10) Patent No.: US 10,617,901 B2
(45) Date of Patent: Apr. 14, 2020

(54) FRAME STRUCTURE FOR A MINI TRAMPOLINE

(71) Applicant: Angehrn AG Umformtechnik, Degersheim (CH)

(72) Inventors: Christian Mehr, Kirchberg (CH); Erwin Bisang, Huenenberg (CH)

(73) Assignee: Angehrn AG Umformtechnik, Degersheim (CH)

( * ) Notice: Subject to any disclaimer, the term of this patent is extended or adjusted under 35 U.S.C. 154(b) by 177 days.

(21) Appl. No.: 15/536,561

(22) PCT Filed: Dec. 15, 2015

(86) PCT No.: PCT/EP2015/079688
§ 371 (c)(1),
(2) Date: Jun. 15, 2017

(87) PCT Pub. No.: WO2016/096784
PCT Pub. Date: Jun. 23, 2016

(65) Prior Publication Data

US 2017/0361143 A1 Dec. 21, 2017

(30) Foreign Application Priority Data

Dec. 16, 2014 (EP) ..... 14198323

(51) Int. Cl.
*A63B 5/11* (2006.01)
*A63B 5/08* (2006.01)
(Continued)

(52) U.S. Cl.
CPC ..... *A63B 5/11* (2013.01); *A63B 5/00* (2013.01); *A63B 5/08* (2013.01); *A63B 5/12* (2013.01); *A63B 5/16* (2013.01); *A63B 2210/50* (2013.01)

(58) Field of Classification Search
CPC .... A63B 5/00; A63B 5/08; A63B 5/11; A63B 5/12; A63B 5/16
See application file for complete search history.

(56) References Cited

U.S. PATENT DOCUMENTS 3,356,366 A 12/1967 Barthel
4,225,131 A * 9/1980 Sidlinger ..... A63B 5/11 482/27
(Continued)

FOREIGN PATENT DOCUMENTS

AU 2014201017 A1 9/2014
DE 20 2011 001 354 U1 4/2011
(Continued)

OTHER PUBLICATIONS

International Preliminary Report on Patentability of International Application No. PCT/EP2015/079688 dated Jun. 20, 2017 and English Translation, 11 pages.
(Continued)

*Primary Examiner* — Joshua Lee
(74) *Attorney, Agent, or Firm* — Fay Sharpe LLP

(57) ABSTRACT

A frame structure for a mini trampoline includes at least three nodes and at least three elongate internodes, as well as a multiplicity of legs. In each case, two of the internodes are assigned to each other with end portions and are connected rigidly to each other via one of the nodes such that a closed frame lying substantially in one main plane is formed. Each leg is fastened directly to one of the nodes.

17 Claims, 8 Drawing Sheets

(51) Int. Cl.

| | |
|---|---|
| *A63B 5/16* | (2006.01) |
| *A63B 5/00* | (2006.01) |
| *A63B 5/12* | (2006.01) |

(56) References Cited

U.S. PATENT DOCUMENTS

| | | | | |
|---|---|---|---|---|
| 4,339,123 | A | 7/1982 | Rich | |
| 4,381,861 | A * | 5/1983 | Howell, Jr. | A63B 5/11 108/155 |
| 4,630,816 | A | 12/1986 | Hill | |
| D666,266 | S | 8/2012 | Publicover et al. | |
| 9,089,732 | B2 * | 7/2015 | Andon | A63B 5/11 |
| 2005/0137061 | A1 | 6/2005 | Wang et al. | |
| 2005/0143225 | A1 | 6/2005 | Adams | |
| 2010/0240496 | A1 | 9/2010 | Chen | |
| 2012/0289379 | A1 | 11/2012 | Stokes et al. | |
| 2013/0316876 | A1 | 11/2013 | Publicover et al. | |
| 2014/0274570 | A1 | 9/2014 | Chen | |
| 2016/0310774 | A1 * | 10/2016 | Publicover | A63B 5/11 |

FOREIGN PATENT DOCUMENTS

| | | | |
|---|---|---|---|
| DE | 20 2010 017 396 | U1 | 1/2012 |
| DE | 20 2007 019 707 | U1 | 2/2016 |
| EP | 2 073 901 | A1 | 7/2009 |
| EP | 2 523 734 | A1 | 11/2012 |
| EP | 2 559 460 | A1 | 2/2013 |
| GB | 2 496 313 | A | 5/2013 |
| WO | WO 2008/029170 | A1 | 3/2008 |
| WO | WO 2009/098324 | A2 | 8/2009 |
| WO | WO 2011/083093 | A1 | 7/2011 |
| WO | WO 2012/167313 | A1 | 12/2012 |

OTHER PUBLICATIONS

International Search Report of International Application No. PCT/EP2015/079688 dated Mar. 21, 2016, 6 pages.
https://www.jumpsport.com/fitness-trampoline-model-350/, Jumpsport, 2017, 1 page.
https://www.bellicon.com/shop/ch_de/trampolin-shop/configurator/bellicon-premium-49.html, Bellicon, 2016, 1 page.
http://www.trimilin.ch/shop/12-trimilin-med.html, Trimilin, 2016, 1 page.
https://www.hudora.de/cat/index/sCategory/130, Hudora, 2017, 1 page.
https://swem.ch/, SWEM, 2017, 1 page.
http://www.tutti.ch/zuerich/garten-handwerk/gartenausstattung/angebote/miami-life-fitness-trampolin_14004555.htm, Miami Life Fitness Trampolin, 2017, 1 page.
https://www.galaxus.ch/de/s3/product/kettler-trampolin-95cm-fitnesstrampolin-2756159, Kettler, 2016, 1 page.
http://www.i-bounce.com.sg/, i-bounce, 2016, 1 page.
http://shop.chi-zentrum.ch/Rebounder-Trampoline/Medi-Swing.html, Mediswing, 2017, 1 page.

* cited by examiner

FIG. 1a
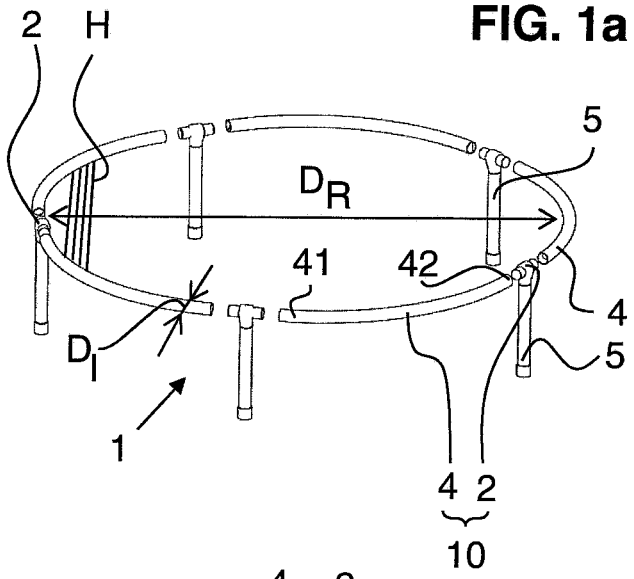
FIG. 1b
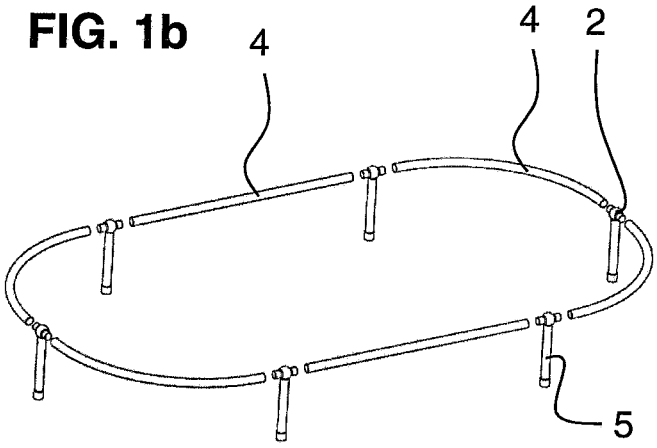
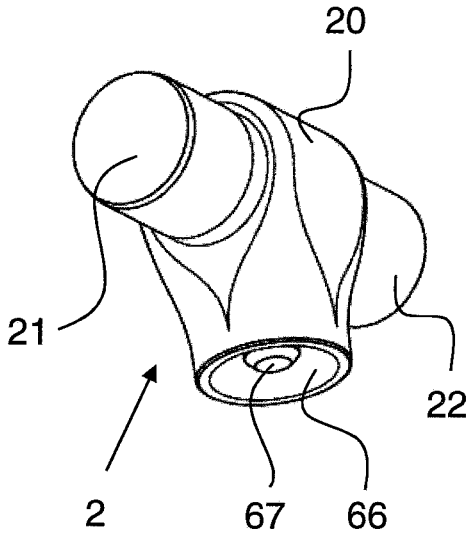
FIG. 2

FIG. 5
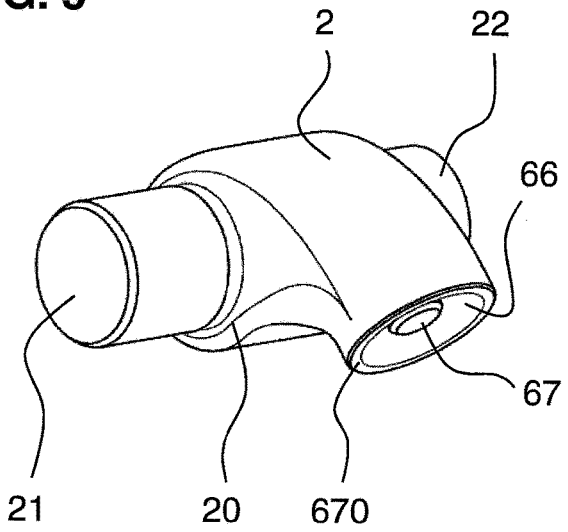
FIG. 7
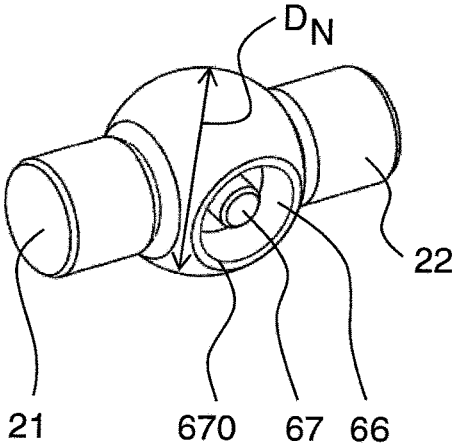
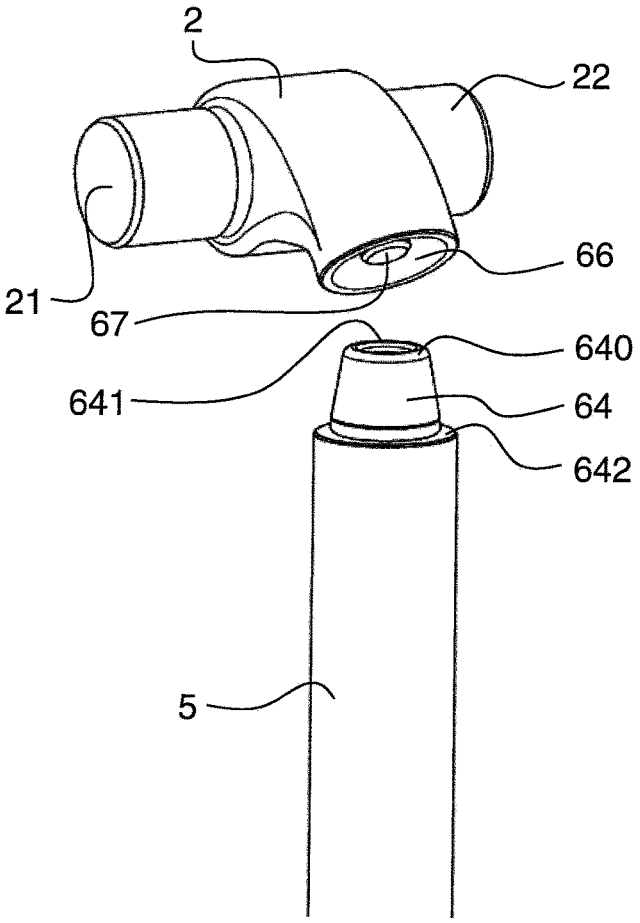
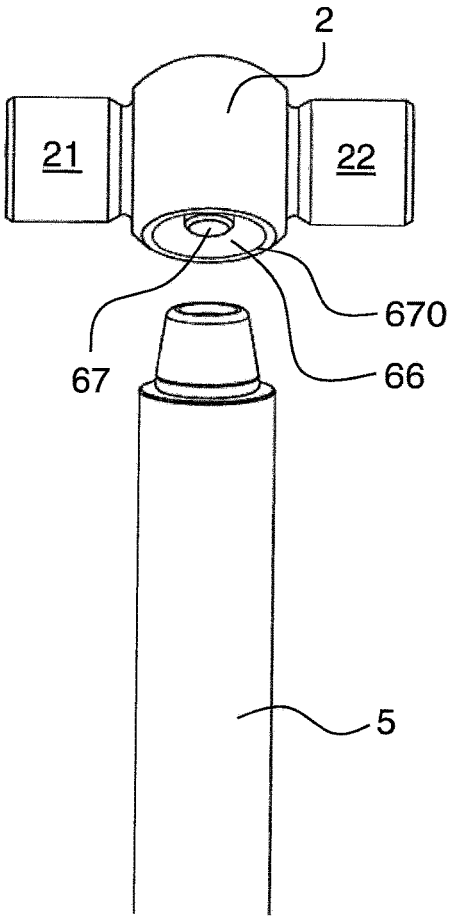
FIG. 6
FIG. 8

FIG. 9
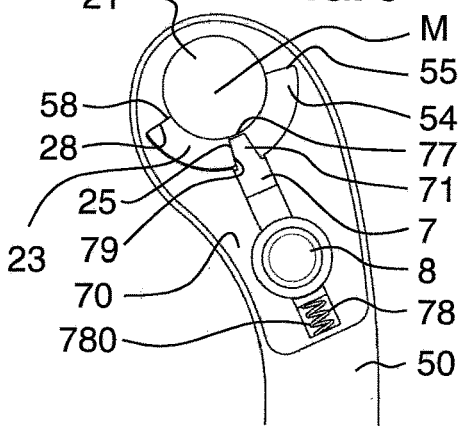
FIG. 11
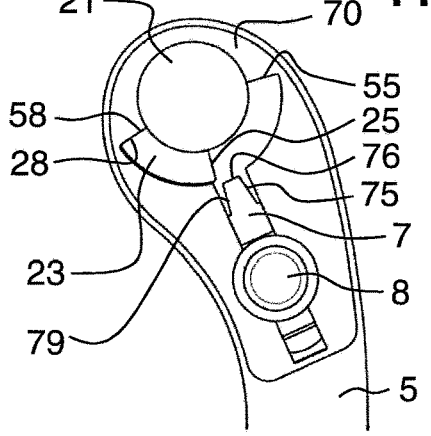
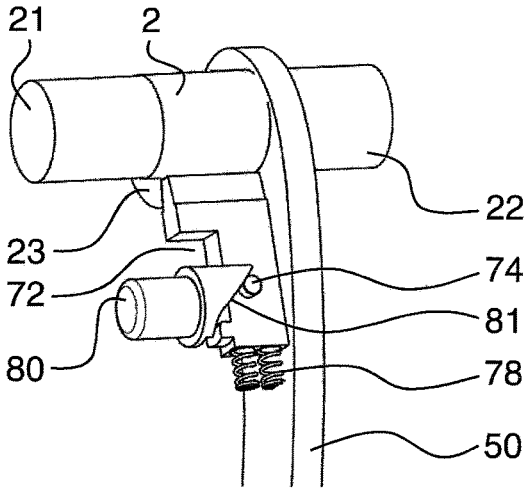
FIG. 10
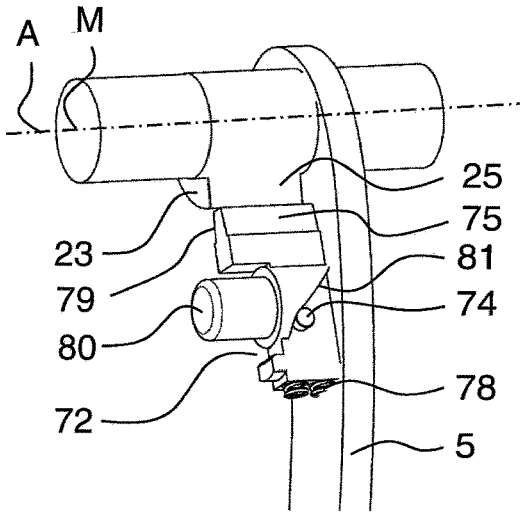
FIG. 12
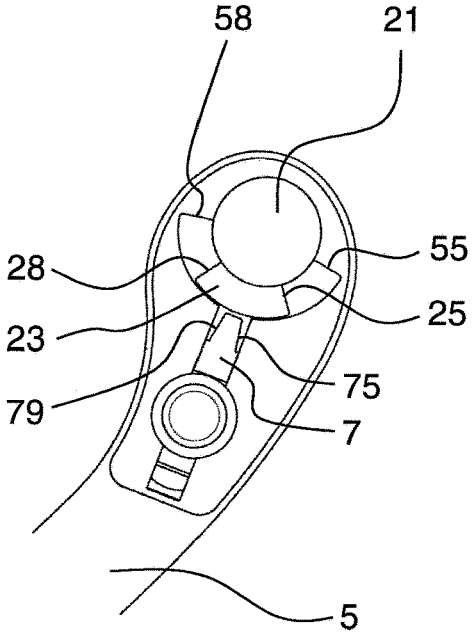
FIG. 13
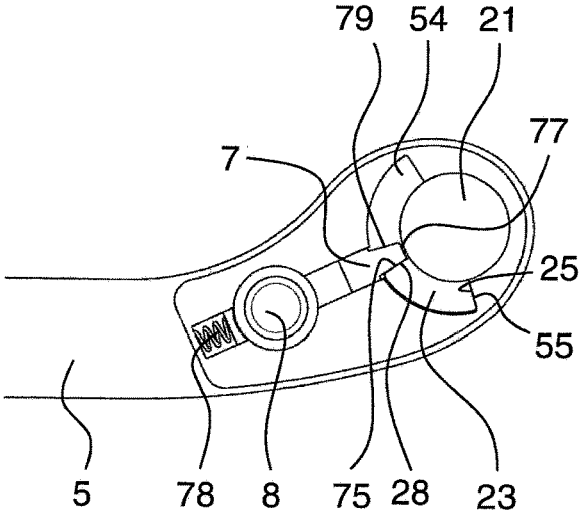
FIG. 14

FIG. 19
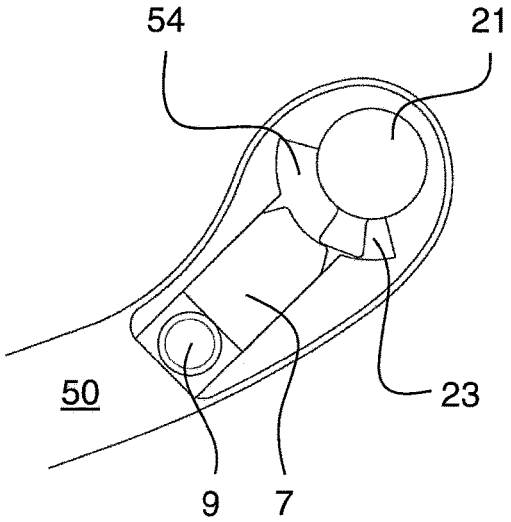
FIG. 21
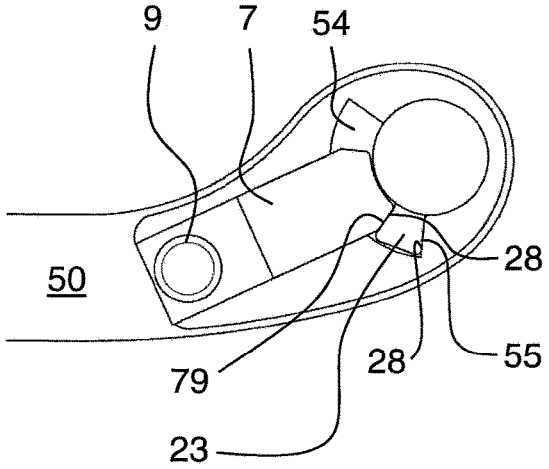
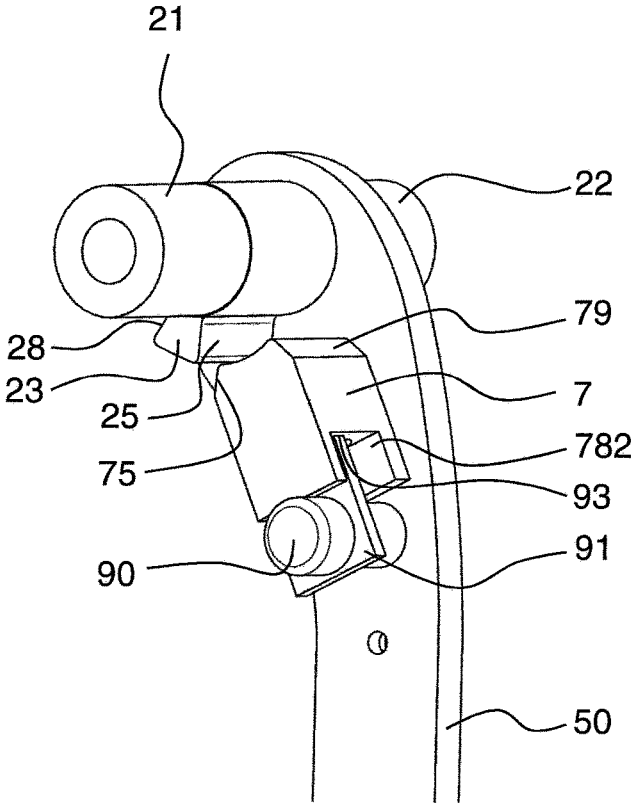
FIG. 20
FIG. 22
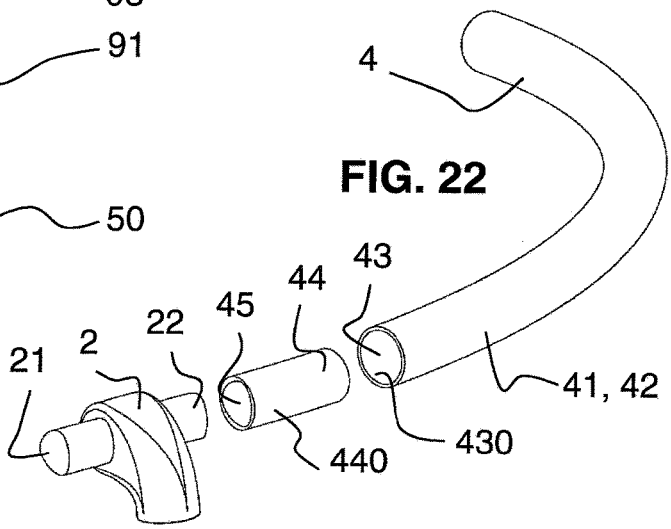

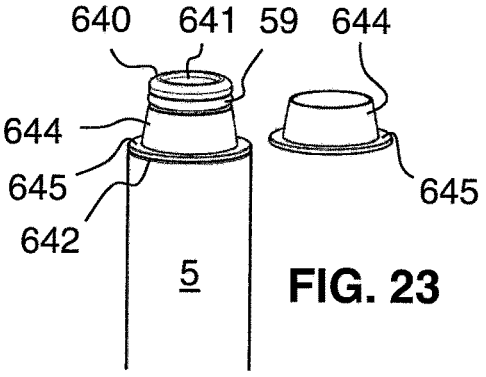
FIG. 23
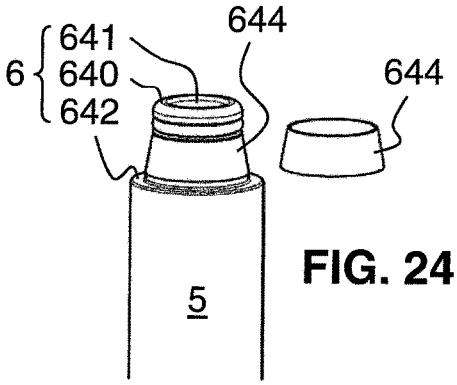
FIG. 24
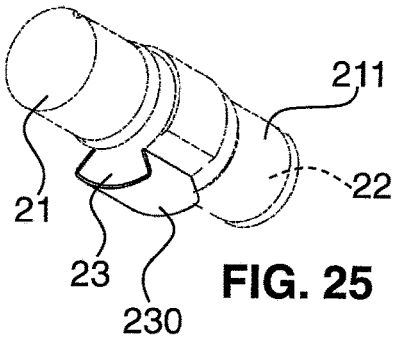
FIG. 25
FIG. 26
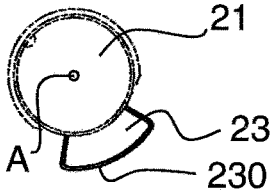
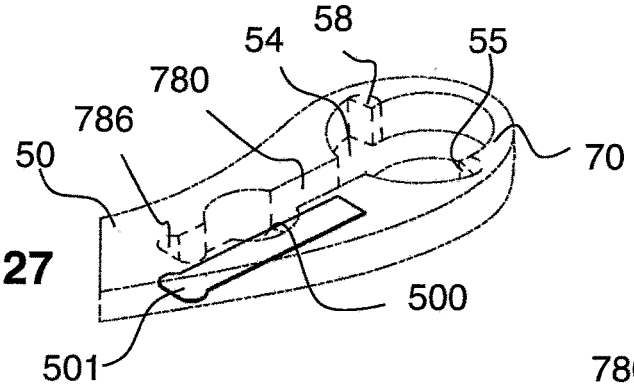
FIG. 27
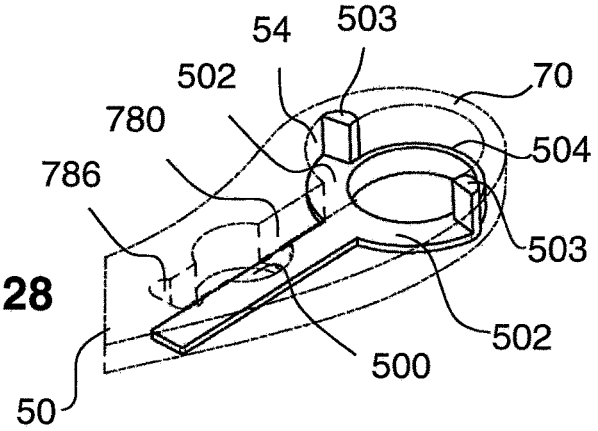
FIG. 28

FRAME STRUCTURE FOR A MINI TRAMPOLINE

TECHNICAL FIELD

The present invention relates to a frame structure for a mini trampoline and to a mini trampoline comprising such a frame structure.

PRIOR ART

Provided under the general term of trampoline are two fundamentally different types of devices which greatly differ with regard to their requirements, use and structure. These are firstly leisure, garden and sports trampolines and secondly health, rehab or mini trampolines (also called rebounders).

Leisure, garden and sports trampolines have a diameter of over 2 meters, generally of 3 meters to 5 meters. The rebounding mat of said devices is located at least 60 centimeters to 100 centimeters above the firm ground. On devices of this type, people attempt to experience jumps which are as high and vigorous as possible—jump heights of between 1 meter and 3 meters are customary; sports people even manage jump heights of over 5 meters on special devices.

When a person takes off with the aid of a trampoline, he returns fractions of a second later to earth or to the rebounding canvas. During the landing, the device (and the body) are loaded by forces which correspond to a multiple of the normal bodyweight. In the case of leisure, garden and sports trampolines, loadings in the region of four to eight times the gravitational acceleration occur. A jump frequency can be up to 40 to 60 times per minute. So that forces of this type can be permanently absorbed by the device, the rebounding mats have to be connected to the stable supporting structure with powerful springs of very varied type or with a different type of elasticity system (for example rubber cables, rubber bands, prestressed carbon or spring steel strips). In addition to the vertically acting forces, considerable horizontal forces or transverse forces can also act on the structure of the rebounding platform depending on the type of jump.

It emerges from the abovementioned facts that leisure, garden and sports trampolines and the specific manner of use thereof require a solid structure. The dimensions of linkages and connections have to be considerable. As a result, such devices weigh at least 20 kilograms, but generally 60 kilograms to 200 kilograms. In addition, leisure, garden and sports trampolines are generally used in the open air and therefore have to be weatherproof. On account of their size, these devices are assembled from pre-manufactured elements at the location of use.

By contrast, mini trampolines within the meaning of the present invention are customarily provided with a diameter of 100 centimeters to 150 centimeters. Their rebounding mat is positioned 20 centimeters to 35 centimeters above the firm ground. Devices of this type are used for obtaining positive impulses for promotion of personal health, for relaxation and for physiotherapeutic exercises. The type of use can be specified with rocking, swinging and slight jumping. The feet customarily remain in this case in the vicinity of the mat plane—i.e. mini trampolines are configured for maximum jump heights of 10 centimeters to 40 centimeters. During normal use, load peaks within the range of 2.5 times to 3.5 times the gravitational acceleration result.

Mini trampolines are generally used at home or in rooms. They are often frequently erected or moved in the day. This use requirement results in the pressure for lightweight and nevertheless stable structures. The weight of mini trampolines should not exceed 10-15 kilograms, otherwise the customer use is significantly limited. Mini trampolines are virtually always delivered in the assembled state. Optimum benefit would require the devices to function virtually without any noise because noises distract from concentrating on the body posture and therefore diminish the preventative-therapeutic benefit.

The chassis frame of mini trampolines with legs have been constructed in the same manner for decades: a ring is bent from a steel tube, the end portions are cut to size and fixedly connected to one another with an orbital weld seam. For the installation of the legs, elements of screw or plug-in connections or folding mechanisms are attached to the ring.

Considerable material losses of 15% to 25% of the frame circumference occur during the bending of the round tube frame. This is in particular because of the necessary advance and retardation during the bending process in a 3-roll bending press. Moreover, time-consuming refinishing work is necessary at the weld connections—for example grinding, polishing and dressing, which has a negative influence both on the quality and the production costs of the mini trampoline.

Nowadays, mini trampolines are known in which the legs are attached by means of screw connections. For this purpose, threaded stubs are welded to the frame and corresponding thread turns are cut into the leg tubes. However, structures of this type are susceptible to damage in practice (experience has shown that users often drop legs when screwing them on and unscrewing them, which leads to damage of the thread on the leg tube). Damaged threads lead to even more rapid wearing out of the connection and therefore to wobbling and rattling of the legs. Structure variants with stubs for the legs screwed on instead of welded on have a tendency, when used as intended, to wear out more rapidly in the connecting zones. The connection of the elements joined into one another deteriorates with increasing use and the legs wobble under loading by jumps. After a short time, such devices therefore lose their original swing quality and therefore a large portion of their benefit.

A further customary structural form uses inverted U-shaped elements, i.e., for example, two legs connected to an integrated web, wherein in each case two legs come to stand next to each other and are joined together to form a 4- to 8-cornered structure. The webs then form the frame for the rebounding mat.

Not all users have sufficient space in their flat in order to allow their training trampoline to be permanently erected. Many users want to (or have to) put away their training device between the individual rounds of exercise in as space-saving a manner as possible. The conversion from the use state to the putting-away state is intended to be undertaken rapidly and conveniently.

In the case of the devices customary nowadays with folding legs, stubs are generally welded to the frame tube. Said stubs are slotted in the center. A guide rod is mounted on an axis of rotation in the slot. The opposite end of the guide rods is anchored in the tube of the leg with the aid of a snap ring. A spring serves to press or to pull the leg in the folded or unfolded state onto the frame or onto the stubs.

Due to the manner of production, the slotted stubs generally have extremely sharp edges. This product characteristic has already led to quite a number of serious cutting injuries and also to damage to floors and furniture.

During the preparation for use of the device (unfolding), the tube is pulled out by a few centimeters counter to the spring force, is pivoted by 90° and is then pushed over the fixedly mounted stubs. This gives rise to a more or less stiff connection between leg and frame.

SUMMARY OF THE INVENTION

It is an object of the present invention to specify an improved frame structure for a mini trampoline. The frame structure is intended to be produced in a stable, material-saving and cost-efficient manner. It is intended to be quiet during use and reduce the risk of injury to people and the risk of damage to property during operation/when putting away.

This object is achieved by a frame structure for a mini trampoline, said frame structure comprising at least three nodes, at least three elongate internodes and a plurality of legs, wherein in each case two of the internodes are assigned to each other with end portions and are fixedly connected to each other via one of the nodes such that a preferably at least in part round and closed frame lying substantially in a main plane is formed. In this case, each leg is in each case fastened directly to one of the nodes.

The invention is based on the finding that a modular construction consisting of nodes and internodes with legs which are fastened to the nodes permits an optimum frame structure for a mini trampoline, said frame structure providing an efficient assembly and a durably high swing quality. The structure herein proposed is therefore superior to conventional frames because of greater user comfort and also has significantly greater stability.

The term "nodes" should be understood as meaning functional connecting elements or connecting junctions to which frame segments, i.e. the internodes, and the legs are fastenable. The nodes are part of the trampoline frame. The nodes can have a differing configuration, from spherical beyond ellipsoidal to deformed convex bodies. The node, in particular the simple sphere junction, can be produced cost-effectively as an injected molded, lathe or forged part. This permits the production of a stable low-cost device.

The term "internodes" should be understood as meaning elongate frame segments which can be configured in a rectilinear, arcuate or angled manner. The frame elements can be solid or hollow profiles. Tube segments are preferred. Cross sections of the internodes can be of round, preferably circular configuration, or of polygonal, preferably regular polygonal configuration. The internodes define the frame shape and span the main plane. The frame shape here can be circular, elongate-oval, polygonal or a mixed form thereof. It therefore goes without saying that internodes of very different configuration can be assembled to form a frame as per customer requirement.

The length of the internodes can be kept relatively short. For example, the individual internodes can be of a length of ¼ to ⅛, in particular ⅕ to ⅙ of the overall circumference of the frame. As a result, in particular tube segments can be produced with a minimum loss of material.

A mini trampoline preferably has a maximum inside diameter of the frame structure in the main plane within the range of 80 centimeters to 200 centimeters, preferably within the range of 100 centimeters to 160 centimeters. This inside diameter permits a rebounding mat which is optimum for swinging as intended on the mini trampoline. (Oval devices: ideally 140×220 centimeters—they are preferably used in order to allow severely disabled patients who lie down during therapy, for example paraplegics, tetraplegics, to experience a relaxing swinging which excites the muscular system).

The legs are preferably substantially rectilinear cylinder portions, preferably with a circular cross section. However, the cross section can also be round, oval, partially round or polygonal. The legs preferably each have a foot on the end side, for example made of rubber, in order to avoid slipping on the floor and noises during use. The length of the legs of a mini trampoline perpendicular to the main plane is preferably within the range of 15 centimeters to 40 centimeters, in particular 20 centimeters to 30 centimeters. This leg length permits an adequate rebounding canvas movement for the swinging as intended on the mini trampoline and helps to keep the overall weight of the mini trampoline low.

Dimensions and materials of the frame structure are preferably selected in such a manner that a weight of the frame structure is less than 18 kilograms, preferably less than 16 kilograms, in particular less than 15 kilograms (ideally 10-12 kilograms). Since a mini trampoline is intended to be erected in a simple manner and to be stowable again in a convenient manner after use, such a limitation in the dimensions and/or of the weight is of advantage.

This is furthermore advantageous if the nodes are substantially solid bodies. Due to the size of the mini trampolines or the associated frame structure, the solid configuration provides optimum stability.

The internodes are preferably designed as tube segments. This permits simple and cost-effective production. A maximum node diameter perpendicular to the main surface is preferably larger here than a maximum internode diameter perpendicular to the main surface. The nodes are therefore preferably junction points which, when the frame is assembled, lift slightly above the internodes. The nodes here are preferably designed as convex bodies, particularly preferably as rotation bodies, and are in particular of substantially sphere-like design.

In one exemplary embodiment, at least one node, preferably all of the nodes, is or are designed as wide leg node. Wide leg nodes are deformed in such a manner that they extend outward from the internodes or from the frame structure parallel to the main plane and preferably toward the respective leg, and therefore the legs, which are fastened to the nodes, are set outward with respect to the frame. This results in a wider stand for the mini trampoline, which particularly advantageously reduces a risk of tipping for exercises with great transverse forces and, in addition, permits stackability of the mini trampolines with the legs fitted.

Preferably, the nodes are provided with a first part of a fastening device and the legs with a second part of the fastening device, for fastening in each case one of the legs to in each case one of the nodes. The fastening device here can comprise an integrated screw coupling, bayonet coupling, plug-in coupling and/or other coupling options. The fastening device is preferably designed in such a manner that a connecting axis of the fastening device, along which said leg and node are connectable, run substantially perpendicularly to the main plane. As a result, transverse forces acting on the fastening device can be minimized since a main direction of force runs substantially parallel to the gravitation direction, which improves the endurance of the mini trampoline while obtaining an optimum swing quality.

In one exemplary embodiment, the fastening device is an engagement connection, and the one of the first or second parts of the fastening device comprises a distally tapering conical portion with a free end, and the other of the first or second parts comprises a corresponding, conically outwardly expanding depression or hollow. An engagement recess, preferably a threaded hole, is embedded in the free end of the conical portion. An engagement element corresponding to the engagement recess, preferably a threaded bolt, is arranged in the depression. The engagement element and the engagement recess are therefore shaped in a complementary manner and designed for the mutual engagement. The engagement element, i.e. in particular the threaded bolt, is preferably completely recessed in the depression. The engagement element can reach here as far as a mouth area of the depression or can be completely recessed in the depression. Owing to this arrangement in the depression, the engagement element is surrounded in a protected manner on all sides by a wall of the conical portion and is optimally protected against a damaging mechanical action—for example against damage due to impact or dropping.

The conical geometry additionally ensures optimum orientation of the legs and optimum absorption of a compressive load during use, since an axis of the conical connection is parallel to the use-induced action of force between frame and legs.

The cone of the conical connection can be covered by means of an additional layer of material, in particular by means of a cap. The layer of material lies as an interlayer between the conical surface and the node walls forming the depression for the cone. The layer of material prevents the cone from permanently gripping said walls, and therefore the conical connection is optimally releasable. In addition, the layer of material secures the connection against inadvertent unscrewing and minimizes a production of noise during use.

The layer of material can cover the entire lateral surface of the cone. In a development, a top surface of the cone is also covered by said layer of material. It is also conceivable for the cap to have an additional flange structure and to be designed such that the entire contact surface between the node and the leg is covered by the cap.

The layer of material can be composed in particular of plastic. The layer of material is preferably an integral element.

For the fastening of the internodes, the nodes preferably each have two oppositely arranged protruding projections which run in the main plane. Said stub-like projections are cylindrical and can be of rectilinear or arcuate design.

The stubs are preferably angled or shaped in a curved manner such that they are matched to a possible arc curvature of the corresponding internode portion into which the stubs are in each case introduced. This is advantageous since, in the event of a matching curvature, i.e. if the stub and the associated internode portion have the same curvature, a contact surface between the two components is maximized and optimum and in particular precisely fitting connection is possible. A precisely fitting connection optimizes, for example, a possible adhesive connection between the node and the internode; this leads in particular to harmonization of the adhesive layer thickness over the adhesive surface.

In the case of folding legs, the contact surface between node and folding leg can be improved by application of at least one layer of material. For example, a plastics coating can be applied to the projections or pressed into the recess in the leg for receiving the projections. The leg is therefore guided on a sliding layer, which brings about an optimization of the rotational movement, the precision of the bearings and the longevity of the rotary bearing. In particular, an improved rotary bearing function and protection of the respective contact surfaces can be achieved. In addition, the layer of material brings about a greater blocking precision in the folded and in the unfolded state of the folding leg; the blocked folding leg therefore does not rattle.

The layer of material can be composed of plastic or metal. The layer of material is preferably provided as a shaped part.

The internodes can each be provided with a recess on the associated end portions, which recesses are now designed in such a manner that in each case one of the projections mentioned can be plugged in there in a precisely fitting manner. It is particularly advantageous if each projection engages in a precisely fitting manner into the corresponding internode over at least a maximum frame thickness, in particular over at least 2 centimeters, preferably over at least 3 centimeters or more, with preferably flat contact. By means of a deep engagement, the contact surface between the two elements is enlarged, which additionally stabilizes the connection. In addition, the internode is then pushable over the stub on the node body, which reduces a risk of injury and has a visually attractive appearance.

A preferred variant embodiment makes provision to configure the lateral connecting stubs on the node in a geometrical shape which facilitates unambiguous positioning and compensates for possible material- or machining-induced irregularities on the internode end pieces. For this purpose, adapter pieces preshaped in the radius of the internodes can be introduced on both sides into the internodes and secured in the interior of the internode end portions assigned to the node by adhesive bonding, welding, deformation or combinations of these fastening techniques. In order to compensate for possible impairments of the contact surfaces in the interior of the internode, the adapter pieces can be designed to be longer than the lateral connecting stubs of the node. The adapter parts have cutouts in their interior, said cutouts corresponding to the selected geometrical shape of the lateral connecting stubs. In the definition of the shape, care is taken to ensure the greatest possible contact surface and cost-effective machining possibilities. Stubs and cutouts can be configured, for example, as harmonious triangles, squares or polygons, as multi-tooth profiles or spline shaft profiles.

The nodes and internodes are preferably connected fixedly to one another, preferably in a flat manner, via adhesive bonding, welding, clamping, deformation or riveting or a combination of adhesive bonding, welding, clamping, deformation and riveting.

The internodes are therefore preferably plugged onto the projections. Alternatively, the projections can also have receptacles into which the end portions of the internodes can be plugged. This plug-in connection can also be formed by conical counter pieces.

Said node/internode structure results in a frame structure which can be produced cost-efficiently and has increased stability, which has an optimum effect on the swing quality of the mini trampoline. In addition, the rapid installation process and the variability of the nodes (leg shapes and operating shapes) and of the internodes (in particular in respect of length and shape) facilitates just-in-time production in accordance with the configuration requirements of the customers. Unlike the current situation, substantial cost and storage space savings can therefore be realized.

In a development, the trampoline legs are designed as folding legs. Such a structure affords the advantage that the folding legs can be pivoted from an unfolded position into a folded position, which advantageously reduces the stowage space requirement. In the unfolded position with respect to the frame, the folding legs can be set outward, i.e. can have a wide leg design. For this purpose, the folding leg can be arcuate in the region close to the frame, which permits a wider stand. By means of the pivotability of the folding leg, an extent of the frame structure along the main plane can be reduced essentially to the frame diameter despite the wide leg geometry, by folding the legs.

The folding option provides a rapid alternative to the removal of the screwed-on trampoline legs by undoing the fastening between node and leg for the purpose of stowing the trampoline. Moreover, the legs therefore do not have to be stored separately and cannot be lost.

In one exemplary embodiment, all of the legs are therefore mounted on the node so as to be pivotable along a pivoting movement about a pivot axis between an unfolded and a folded position. In this connection, the node has a first outer rotation stop and the leg has a corresponding second outer rotation stop. Upon striking against each other, the first and second outer rotation stops define the unfolded position of the leg. Each node advantageously additionally has a first inner rotation stop and the corresponding leg preferably has a corresponding second inner rotation stop, wherein the first and second inner rotation stop define the folded position of the leg when they strike against each other.

The unfolded position is advantageously selected in such a manner that the trampoline leg runs substantially perpendicularly to the main plane of the trampoline frame at least in the region of the free end of the leg, i.e. the bottom end. A folded position is ideally selected in such a manner that the free end of the leg, when folded inward, lies close to the rebounding mat which is substantially located in the main plane.

A folding mechanism in which the pivot axis runs through a frame cross section center point of the pivotable leg is particularly preferred here. The pivot point of the folding leg can therefore be integrated in a space-saving manner in the frame, and can preferably be placed into the center of the node and internode cross section. Use can therefore be made of a leg element which is continuous in the longitudinal direction, which has an advantageous effect on the stability, swing quality and operating safety, in particular also in respect of the risk of pinching. For this purpose, the nodes can therefore be designed as rotary joints. In addition, this avoids annoying rattling noises which occur during the use of conventional devices and wobbling movements which increase with the overall use time because of a multi-part leg. Disturbing noises and instability impair in particular the concentration on the body posture of the user and thus reduce the therapy benefit. The rotary node proposed here therefore permits a particularly quiet folding solution with a stable stand and space-saving putting-away properties. In addition, operating convenience of the folding mechanism is optimized to one-handed use, and at the same time the frame structure is quiet during use and the risk of injury to people and damage to property during the operation/putting-away are minimized.

In order to avoid undesirable pivoting of the trampoline legs, in a development a lock can be provided in the folding operation. The frame structure can therefore comprise a locking element which is mounted on the leg or on the node so as to be displaceable along a locking movement running substantially perpendicularly to the pivot axis between a release position and a locking position. Said locking element is designed for the secure locking of the trampoline leg at least in the unfolded position. In this connection, in the locking position, the locking element blocks the pivoting movement and, in the release position, however, releases same again. The locking element therefore acts on the relative movability between the leg and the node and is arranged in such a manner that, in the locking position, the leg remains stable even during use as intended.

The locking element is preferably held in the locking position under prestress and, with application of force, can be pushed out of the locking position counter to the prestress. In order to produce the prestress, a mechanical compression spring or another compressive means can be used. Depending on the structure, tension springs or tension means are also conceivable.

A first locking stop is preferably arranged on the node, wherein the first locking stop is preferably the first outer rotation stop of the node. Furthermore, a second locking stop is arranged on the locking element, wherein a contact or pressure surface between the first and the second locking stop is substantially parallel to the locking movement. It can be inclined, for example, 0° to 10° to the radial direction with respect to the pivot axis. By means of this orientation, the two stops strike substantially frontally against each other without movement-triggering transverse forces occurring.

An actuating element which is actuable manually from the outside is preferably provided, which actuating element, upon actuation, acts on the locking element in such a manner that the locking element is transferable from the locking position into the release position. The actuating element can in particular provide a control curve which lines up with a pin on the locking element. The arrangement is then preferably designed in such a manner that, by movement of the actuating element—which is preferably designed as a push-button, alternatively as a lever or the like—, the control curve is pressed along the pin, whereupon the pin executes a movement between the locking position and in the direction of the release position, i.e. away from the pivot axis. The actuating element can itself be prestressed such that, after the actuation action, it automatically returns into the starting position and the cam releases the pin.

Alternatively, the first locking stop can be arranged on the node and the second locking stop can be arranged on the locking element in such a manner that a mutual contact or press-on surface is arranged between the first and the second locking stop at such an angle with respect to the locking movement that the locking element can be pressed out of the locking position into the release position by manual pivoting of the leg. The angular position of the contact surface can be 8° to 20°, in particular 10° with respect to the direction of movement of the locking element, i.e. can be formed just below the self-locking slope. Said press-on surfaces which are at an angle have the effect that some of the torque exerted on the leg is transformed into a force component against the locking element, and therefore the locking element can be pressed out of the locking position into the release position. The leg acts here as a lever.

In order now to secure the lock, a securing element can be provided. In this case, a first securing stop can be provided on the securing element and a second securing stop can be provided on the locking element. The securing element is then designed and arranged in such a manner that it is movable along a securing movement between a securing position and a release position, wherein, when the securing element is in the securing position, the first securing stop lines up with the second securing stop in the locking movement in such a manner that the locking element is blocked in the locking position. In this case, the securing element is movable manually from the outside into the release position, and therefore the locking element can be released.

The securing element can likewise be under prestress, preferably by means of a compression spring, and therefore the securing element passes automatically into the securing position and is held there, until the next actuation.

In a development, the locking element is designed converging conically or in a wedge-shaped manner forward, i.e. counter to the pivot axis, and is surrounded on the end side, i.e. counter to the axis, by a free space in the locking position. By means of this configuration and the advantageous prestress of the locking element in the locking position, the locking element is always automatically readjusted by the action of pressure into the optimum locking position in the event of use-induced structural damage, and therefore a play-free lock is ensured even after prolonged use. In addition, the conical or wedge shape has a centering effect on the locking element. In a particularly preferred development, the locking mechanism therefore furthermore comprises self-adjusting components which guarantee a very substantially play-free securing and function without noise over a long use time in the unfolded and in the folded state.

The locking mechanisms proposed here therefore provide a retaining mechanism and provide high operating and use convenience. In particular, they also permit single-handed operation.

The present invention furthermore relates to a mini trampoline with a frame structure as described above, wherein the mini trampoline furthermore comprises a rebounding mat which lies substantially in the main plane and is stretched onto the frame.

The mini trampoline according to the invention is distinguished by a lastingly high swing quality because of the freedom of play, ensured over the long term, of the connecting points of the stable frame structure.

BRIEF DESCRIPTION OF THE DRAWINGS

Preferred embodiments of the invention are described below with reference to the drawings which serve merely for explanation and should not be interpreted as being limiting. In the drawings:

FIG. 1*a* shows a perspective view of a round frame structure comprising nodes, internodes and legs;

FIG. 1*b* shows a perspective view of an oval frame structure comprising nodes, internodes and legs;

FIG. 2 shows a perspective view of a first embodiment of the node;

FIG. 5 shows a perspective view of a second embodiment of the node, mainly a wide leg node;

FIG. 6 shows a perspective view of the node according to FIG. 5 with a corresponding leg;

FIG. 7 shows a perspective view of a third embodiment of a node, namely a spherical node;

FIG. 8 shows a perspective view of the node according to FIG. 7 with a corresponding leg;

FIG. 9 shows a side view of a fourth embodiment of the node with a pivotable leg, wherein the leg is blocked in an unfolded position and in a locking position by a locking element according to a first embodiment;

FIG. 10 shows a perspective view of the node with leg in the situation according to FIG. 9;

FIG. 11 shows a side view of the node with leg according to FIG. 9, wherein the locking element has been brought downward out of the locking position into a release position;

FIG. 12 shows a perspective view of the node with leg in the situation according to FIG. 11;

FIG. 13 shows a side view of the node with leg according to FIG. 9, wherein the leg has been pivoted to the left out of the unfolded position toward a folded position;

FIG. 14 shows a side view of the node with leg according to FIG. 9, wherein the leg has been brought to the left out of the unfolded position into the folded position;

FIG. 19 shows a side view of the node with leg according to FIG. 17, wherein the locking element has been pushed fully into the release position and the leg has been pivoted further to the left out of the unfolded position toward a folded position;

FIG. 20 shows a perspective view of the node with leg in the situation according to FIG. 19;

FIG. 21 shows a side view of the node with leg according to FIG. 17, wherein the leg has been pivoted into the folded position; the locking element has been returned because of its prestressed mounting into the locking position and the securing element into the securing position;

FIG. 22 shows a perspective view of an adapter piece for connecting node and internode;

FIG. 23 shows a development in which the cone of the leg according to FIG. 3 or FIG. 4 is covered with a cap with a flange, and such a cap;

FIG. 24 shows a development in which the cone of the leg according to FIG. 3 or FIG. 4 is covered with a cap without a flange, and such a cap;

FIG. 25 shows, in a perspective view, the node with the cam, wherein the cam is enclosed according to a development;

FIG. 26 shows the subject matter of FIG. 25 in a side view;

FIG. 27 shows a leg portion of a development of the folding leg, wherein a first embodiment of an insert has been placed into the leg portion for optimally guiding the locking element;

FIG. 28 shows the leg portion of the folding leg according to FIG. 27, wherein a second embodiment of the insert has been placed into the leg portion;

DESCRIPTION OF PREFERRED EMBODIMENTS

Figure 3:
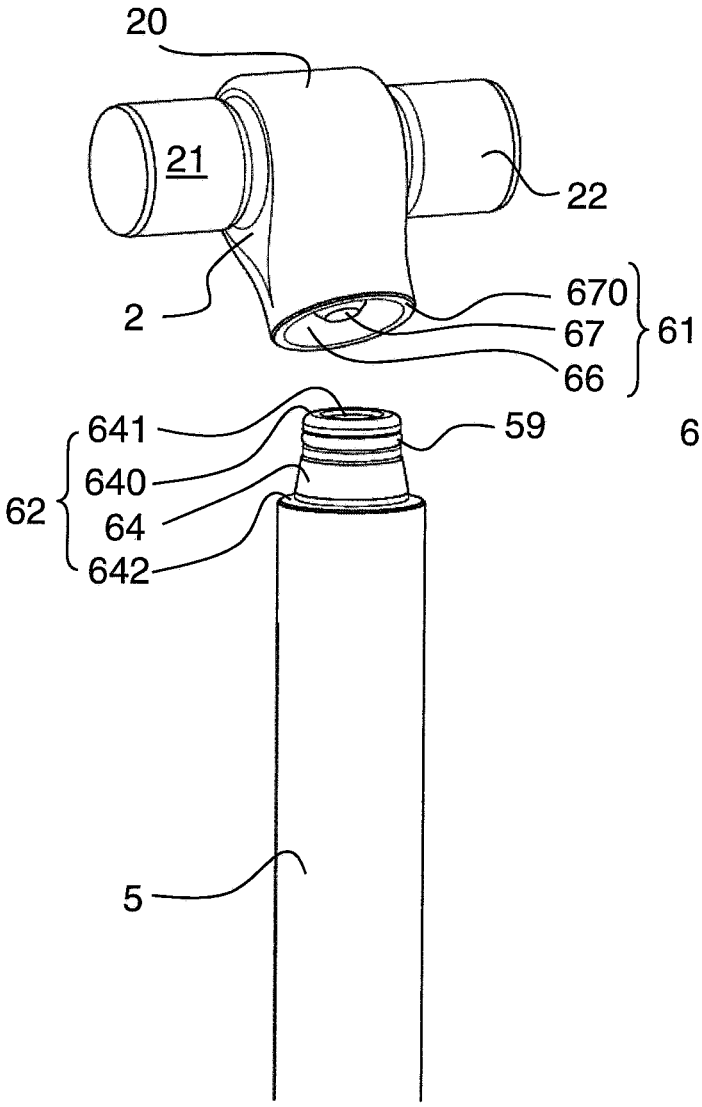
FIG. 3 shows a perspective view of the node according to FIG. 2 with a corresponding leg.

Preferred embodiments will now be described with reference to FIGS. 1*a* to 21.

FIG. 1*a* schematically shows a preferred embodiment of a frame structure 1 according to the invention. The frame structure 1 comprises nodes 2, internodes 4 and legs 5. In the embodiment illustrated, the internodes 4 are arcuate tube segments, wherein in each case one node 2 is arranged between two end portions 41, 42 of two associated internodes 4. The nodes 2 are fitted and fastened in a precisely fitting manner into the internodes 4, and therefore a substantially circular frame 10 with downwardly protruding legs 5 is formed. The frame 10 defines a main plane H.

A frame diameter DR is between 100 centimeters and 200 centimeters. A tube diameter $D_I$ of the internodes 4 is 2.5 centimeters to 4 centimeters, preferably approximately 3 centimeters.

A respective leg 5 is fastened to each of the nodes 2.

In a particularly preferred embodiment, as illustrated in FIG. 1*a*, the frame structure 1 has five nodes 2, five internodes 4 and five legs 5. It goes without saying that in each case 3, 4, 6, 7, 8 or more nodes 2 and internodes 4 can be joined together to form a frame 10. Differently arcuate or shaped internodes 4 can also be used.

FIG. 1*b* shows an oval embodiment with four quarter-circle-shaped internodes 4, two rectilinear internodes 4 and six nodes 2 each having one leg 5. This embodiment is particularly suitable for lying use (i.e. the lying person is caused passively to swing by a second person).

FIG. 2 shows perspectively a first embodiment of the node 2 in detail. A node body 20 of the node 2 wraps around a solid cylinder, and therefore two stubs 21, 22 protrude to the sides of the node body 20. The stubs protrude by 2 centimeters to 6 centimeters from the node body 20 and have a diameter of approximately 2 centimeters to 3.5 centimeters. The stubs 21, 22 are shaped here in such a manner that they are introducible into corresponding recesses 43 at the free ends of the internodes 4 in a precisely fitting and complete manner. The recesses 43 on the internodes 4 are therefore preferably of such a depth that the respective stub 21, 22 can be completely accommodated. A maximum contact surface between stubs 21, 22 and internode 4 is therefore possible, which permits a secure connection of the two elements 2, 4.

In a particularly preferred embodiment according to FIG. 22, adapter pieces 44 are inserted into the recesses 43 on the free end portions 41, 42 of the internodes 4. An outer surface 440 of the adapter pieces 44 makes contact with a contact surface 430 bounding the recess 43. The outer surface 440 and the contact surface 430 are preferably securely adhesively bonded. These adapter pieces 44 have at least outwardly open cutouts 45 which are shaped in a manner corresponding to the stubs 21, 22 to be received. The stubs 21, 22 can therefore be inserted into the cutouts 45 in a precisely fitting manner. Said cutouts 45 and stubs 21, 22 are preferably shaped in such a manner that a rotationally fixed and well-defined connection is made possible between internode 4 and node 2. FIG. 22 shows a substantially triangular cross-sectional shape with rounded corners. The cutouts 43 and stubs 21, 22 can furthermore have as cross-sectional shape a harmonious triangular, square or polygonal shape, a multi-tooth profile or spline shaft profile.

The cutouts 43 are preferably deeper in the longitudinal direction of the internode 4 than the stubs 21, 22 are long, and therefore the stubs 21, 22 are completely accommodated in the cutouts.

By the provision of these adapter pieces 44, an optimum and secure accommodating of the stubs 21, 22 in the internode end portions 41, 42 is possible.

The node body 20 according to FIG. 2 is designed such that it is extended longitudinally downward in FIG. 2 and has a first part 61 there of a fastening 6 for fastening the leg 5. At the free end facing the leg 5, the first part 61 has the same cross section as the leg 5. This cross section is preferably circular. Alternatively, it can also be partially round, round or polygonal.

A conical depression 66 is provided in the free lower end of the node body 20. The depression 66 has a circular cross section and tapers counter to its depth in such a manner that a mating cone 64 of the leg 5 can be inserted in a precisely fitting manner. An angle of inclination of the cone 64 can be 5° to 10° with respect to the longitudinal axis of the cone. An engagement element 67, here a threaded bolt, is recessed centrally in a center of the depression 66 and is surrounded in a protected manner on all sides by the node body 20. The node body 20 protrudes over the threaded bolt 67 by 1 millimeter to 5 millimeters, and therefore the bolt 67 is optimally protected on all sides against damage due to dropping and impact. The threaded bolt 67 with a diameter of 5 millimeters to 12 millimeters runs perpendicularly to the longitudinal extent of the stubs 21, 22 and through a central axis A of the stubs 21, 22. The bolt 67 is preferably beveled at its free end.

Figure 4:
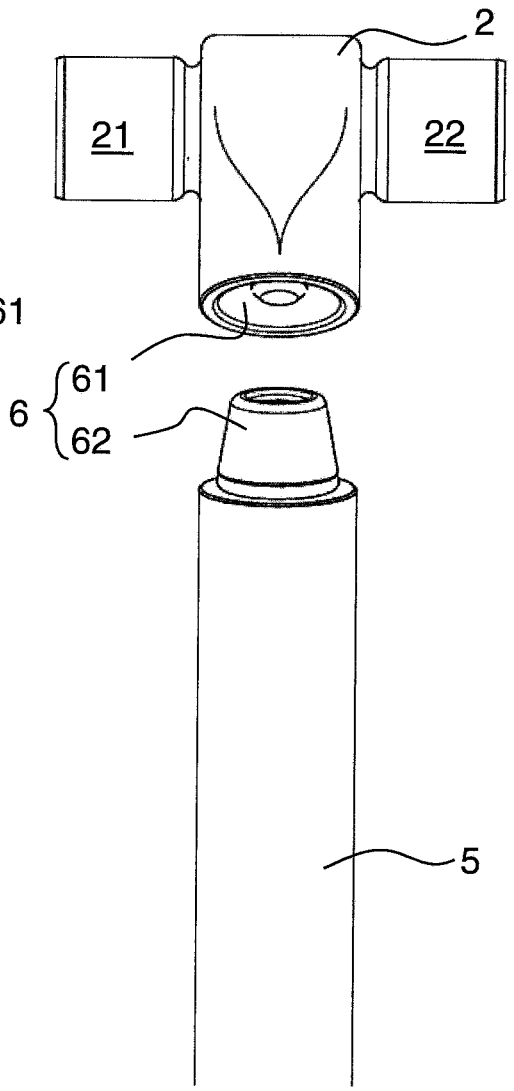
FIG. 4 shows a frontal view of the node and of the leg according to FIG. 3.

FIGS. 3 and 4 show a perspective view and a frontal view of the node according to FIG. 2 with the corresponding leg 5. The leg 5 is a rectilinear tube segment and preferably has a standing foot at one end for contact with the ground and a second part 62 of the fastening 6 at the other end. The second part 62 of the fastening 6 is provided by the free conical portion 64 which is shaped in a precisely fitting, mirror-inverted manner with respect to the depression 66 and therefore tapers in the distal direction toward the node 2. In addition, an offset 642 is provided at the proximally, wide end of the conical portion 64, said offset being designed in such a manner that an edge or an end surface 670 of the node body 20 can be placed thereon in a manner flush to the outside. The offset 642 and the end surface 670 therefore have substantially the same outside and the same inside diameter and lie substantially transversely with respect to the longitudinal axis of the leg 5. An offset-free transition from the node 2 to the leg 5 is therefore ensured to the outside, and an optimum lateral support for good stability is provided on the inside.

An engagement recess 641 projecting in the longitudinal direction of the leg 5 is embedded at a free end 640 of the conical portion 64. The engagement recess 641 runs from the outside in the proximal direction, substantially parallel to the longitudinal direction of the leg 5 into the depth of the latter. A wall of the engagement recess 641 or of the conical portion 64 preferably has a thickness of at least 2 millimeters to 5 millimeters in the vicinity of its free end 640, increases in the proximal direction and is provided with a thread which corresponds to the thread of the threaded bolt 67.

In practice, the leg 5 can now be screwed onto the node 2 by a rotational movement, wherein the threaded bolt 67 is screwed into the engagement recess 641 and at the same time the conical portion 64 pushes forward into the depression 66 until outer surfaces of the node body 20 and of the leg 5 butt flush against each other.

The connecting axis of the fastening 6 runs parallel to the longitudinal extent of the leg 5, and therefore an optimum force transmission and centering between node 2 and leg 5 is possible with minimal transverse loading of the threaded connection 67, 641.

Since both the thread of the bolt 67 and the thread of the engagement recess 641 are recessed, the threaded connection is optimally protected against damage due to dropping or impact.

FIG. 3 furthermore shows that an encircling groove into which an O-ring 59 is placed and protrudes laterally over the groove can be provided on an outer surface of the conical portion 64. When the leg 5 is connected to the node 2, the elastic O-ring is then compressed and thus ensures a clamping force between node 2 and leg 5, which prevents the connection 6 becoming loosened or even released during use.

In a development, the outer surface of the cone 64 is covered with an additional layer of material. This is shown in FIGS. 23 and 24.

FIG. 23 shows leg 5 with the conical portion 64, wherein the O-ring 59 is placed into a notch in the upper end region of the cone 64 and the lateral conical surface of cone 64 is covered with a cap 644. The cap 644 (shown on the right on its own in FIG. 23) has an encircling flange 645 at its lower end and is designed in such a manner that it can simply be plugged or pushed onto the cone 64. The flange 645 which is directed outward in the manner of a hat brim is configured in such a manner that it comes to lie against the step 643 of the leg 5 and covers said step. If the conical connection is then produced, the layer of material of the cap 644 thus lies between the leg 5 and the first part 61 of the fastening device 61 (see, for example, FIGS. 3 and 4).

FIG. 24 shows a cap 644 in a further embodiment without the flange 645.

In all of the embodiments, the cap 644 can be used alternatively or additionally to the O-ring 59.

In a development that is not illustrated, further surfaces, such as, for example, the distal end surface at the free end 640, can be covered with a layer of material of the cap 644. Such a covering can be realized, for example, by means of a further flange directed inward in the manner of a hat brim.

The layer of material of the cap 644 locally prevents the direct contact between node 2 and leg 5. By means of micro vibrations during use, node 2 and leg 5, in particular in the event of an identical choice of material for the two elements, can permanently grip against each other if a cap 644 is not inserted. In this case, high stiction could occur, which is disadvantageous for the removal of the legs 5. The layer of material 644 can avoid such a locally increased stiction between node 2 and leg 5. Such micro vibrations occur, for example, if the leg 5 is only inadequately tightened during use of the trampoline. Furthermore, an inadvertent unscrewing of the screw connection can be countered by the layer of material 644, and therefore the screw connection is secured. Rattling noises can also be reduced by means of the cap 644.

The layer of material 644 can be formed, for example, from plastic. The cap 644 is preferably an integral shaped part. FIGS. 5 and 6 show a perspective view and a frontal view of a second embodiment of the node 2, namely a wide leg node 2. FIG. 6 additionally shows the leg 5, as is also shown in FIG. 4. The wide leg node 2 according to FIGS. 5 and 6 has the same function and structure as the node 2 according to FIGS. 3 and 4, with the exception that the free end of the node body 20 is now arranged in a laterally offset manner. The lower free end of the node body 20 is therefore displaced laterally. The threaded bolt 67 therefore no longer runs through the longitudinal axis of the stubs 21, 22 but offset 1 to 8 centimeters with respect thereto, but always still substantially perpendicularly to the main plane H. By means of the design of the wide legs, the legs 5 are set outwards with respect to the frame 10. The stand of the frame structure 1 is therefore enlarged and, as a result, a tendency of the frame structure 1 to tip is reduced. Furthermore, by deployment of the legs 5, the frame structure 1 is stackable with the legs 5 fitted since the legs 5 run offset with respect to the frame 10.

FIGS. 7 and 8 show a perspective view and a frontal view of a third embodiment of the node 2, namely a spherical node 2. FIG. 8 additionally shows the leg 5, as is also shown in FIG. 4. The spherical node 2 according to FIGS. 7 and 8 has the same function and structure as the node 2 according to FIGS. 3 and 4, with the exception that the node body 20 is now of substantially spherical configuration. In the region of the depression 66, the sphere 20 is now of course flattened by the removed material. A mouth area of the depression 66 forms the flat side of the sphere 20. A diameter $D_N$ of the sphere 20 is approximately one and a half to two times the size here as a diameter of the stubs 21, 22.

FIGS. 9 to 14 show a fourth embodiment of the node 2 with a pivotable leg 5. FIG. 9 shows the leg 5 in an unfolded position and blocked in a locking position by a locking element 7 according to a first embodiment. FIG. 10 shows, in a perspective view, the node 2 with the leg 5 in the situation according to FIG. 9. The pivoting leg 5 according to FIGS. 9 to 14 has two leg limbs 50 running in parallel. For the sake of clarity, only one of the limbs 50 is illustrated in FIGS. 9 to 14. The leg limbs 50 are arcuate in the upper region, and therefore the leg 5 is set outward in the unfolded position according to FIG. 9, which increases a standing width of the frame structure 1 and results in a significantly enlarged overall standing surface.

The limbs 50 are mounted on the node 2 so as to be rotatable about the stubs 21, 22 and are pivotable inward toward the main plane H between an unfolded position according to FIG. 9 and a folded position according to FIG. 14. The stubs 21, 22 remain in the mean time in a rotationally fixed manner in the respective internodes 4. Between the limbs 50, the locking element 7 is held displaceably in a bearing 70 attached fixedly to the limbs 50. The locking element 7 is configured as a bolt which is mounted displaceably perpendicularly to the pivot axis A of the stubs 21, 22. For this purpose, the locking element 7 is guided in a bolt recess 780 which is provided in the bearing 70 and leads directly to the center axis A of the stubs 21, 22. At the stub-side end, the bolt recess 780 opens into a rotation recess 54 which runs in a virtually semicircular manner around the stubs 21, 22, is approximately 1 centimeter deep in the radial direction with respect to the center axis A of the stubs 21, 22 and is likewise located in the bearing 70. The locking element 7 now lies in the bolt recess 780 which is closed remotely from the node such that a compression spring 78 can be placed between the locking element 7 and the base of the bolt recess 780, said compression spring partially pressing the locking element 7 out of the bolt recess 780 as far as into the rotation recess 54 and into the locking position according to FIG. 9. The locking element 7 is therefore prestressed by the spring 78.

On the stub side, the locking element 7 has an end portion 71 tapering distally toward the free end. On the left in FIG. 9, said end portion 71 has a first locking stop 79 which, directed toward the left in FIG. 9, is in the rotation recess 54.

The node 2 furthermore has a cam 23 which projects into the partially annular space 54 and approximately fills the space 54 in the radial direction. During rotation of the leg 5, the stop cam 23 connected in a rotationally fixed manner to the stubs 21, 22 moves in the rotation space 54. The cam 23 has a first inner rotation stop 28 which lies radially in the space 54 and is directed toward the left in FIG. 9. A first outer rotation stop 25 which is directed toward the right is arranged at an end of the cam 23 that lies opposite the first inner rotation stop 28. At an inner circumferential-side end, the partial annular space 54 introduced into the bearing 70 has a second inner rotation stop 58 and a second outer rotation stop 55 on the outside. In this case, the inner rotation stops 28, 58, by striking against each other, define the unfolded position according to FIG. 9, and the outer rotation stops 25, 55, by striking against each other, define the folded position according to FIG. 14. The folded positions are therefore defined by the cam 23 striking against the bearing 70 which is part of the leg 5.

A circumferential-side length of cam 23 and the inner half of the partial annular space 54 are now dimensioned in such a manner that the cam 23 lined up with the first inner stop 58 is also lined up with the first locking stop 79 of the locking element 7 in the locking position. The contact surface between 25 and 79 runs substantially radially, and therefore, even in the event of an action of force on the leg 5, the cam 23 is not capable of pressing the locking element 7 into the bolt recess 780 counter to the force of the compression spring 78. The folding leg 5 according to FIG. 9 is therefore locked securely in the unfolded position.

In a development, the cam 23 is enclosed, preferably in a cap 230. FIG. 25 shows the enclosed cam 23 in a perspective view of the node 2, and FIG. 26 shows the node 2 with the cap 230 in a side view. Sliding and/or wear properties of the cam 23 moving in the partially annular space 54 can be optimized by means of said cap 230.

The cap 230 can cover a side flank of the cam 23, which side flank is directed in the direction of movement of the cam 23. In particular the side flank which is in contact with the locking element 7 when the folding leg 5 is opened up can be covered. However, the cap 230 preferably covers the two side flanks in the direction of movement of the cam 23. It is particularly preferred if the upper side of the cam 23, which upper side is perpendicular to the direction of movement of the cam 23, is also likewise covered by the cap, as shown in FIGS. 25, 26.

In a development, the cap 230 can cover the entire cam 23.

The cap 230 is preferably shaped in such a manner that it can be clamped on the cam 23 and sit securely there for use as intended. In the particularly preferred design bracket cap 230, the latter can be pushed onto the cam 23 and is designed in such a manner that it is securely clamped in an end position on the cam 23 via a clamping force. For this purpose, the cap 230 can be manufactured, for example, from a resilient material.

The cap 230 can be manufactured from metal, in particular from steel, preferably from spring steel or spring bronze.

Such a cap 230 prevents the cam 23 and its counter piece on the node 2, which is preferably formed from aluminum, from becoming wedged. In the embodiments according to FIGS. 9 to 21 said counter piece is provided by wall portions of the leg 5, said wall portions bounding the partially annular space 54 and along which the cam 23 runs. Such a wedging can be caused, for example, by the micro vibrations occurring during use of the trampoline. In extreme cases, such a wedging can block the mechanism in such a manner that normal finger pressure no longer suffices to pull the locking cam 23 back upon push of a button in order to permit the folding or unfolding of the folding leg 5. The cap 230 helps to prevent such a wedging. Furthermore, by means of the enclosure, the premature wear of the cam 23 can be avoided and the sliding properties can be optimized.

In a development, a layer of material 211 (see FIG. 25) can be provided between the stubs 21, 22 and the folding leg 5. The leg portions 50 (see, for example, FIGS. 27, 28) can then be pushed onto said layer of material 211 and move on the layer of material 211 during the folding operations. Said layer of material 211 preferably serves at the same time as an axial and radial bearing and improves the rotary bearing of the folding leg 5 in several respects. An optimization of the rotational movement, the bearing precision and/or longevity of the bearing can be achieved.

In one embodiment, the layer of material 211 can be pressed into the two half shells of the leg 5 or, in another embodiment, can be applied to the stubs 21, 22.

The layer of material 211 can be composed of plastic or metal. It is preferably provided as an integral shaped part.

The layer of material 211 has a protective function for the contact surfaces. For example, a leg portion 50 which is composed of metal, in particular aluminum, can be protected against deformation by compression. In addition, the layer of material 211 brings about a greater blocking precision in the folded and in the unfolded state of the leg 5; the play is therefore reduced when folding or unfolding the leg 5.

It is now explained with reference to FIG. 10 how the folding leg 5 can be released. For this purpose, an actuating element 8 is provided with a pushbutton 80. The pushbutton 80 protrudes through an upper region of the limb 50 that is not illustrated and can thus be pressed from the outside in the direction of the center axis A of the stubs 21, 22 into a recess 72 of the locking element 7 toward the center of the leg. As a result, the folding mechanism is operable simply and single-handedly. As can be seen in FIG. 10, the actuating element 8 is configured remote from the pushbutton as a beveled cylinder, wherein a point of the cylinder lies on the side of the center axis A, and therefore the oblique surface provides a control curve 81 which acts on a laterally protruding pin 74 of the locking element 7. If the pushbutton 80 is now pushed in in the A direction, the curve 81 runs onto the pin 74 and presses the latter counter to the action of force of the spring 78 into the depth of the bolt recess 780. As a result, the locking element 7 is pulled out of the rotation space 54, the rotation space 54 is released, as shown in FIGS. 11 and 12, and the leg 5 can be pivoted.

The actuating element 8 can provide two curves 81 which act on two oppositely arranged pins 74, and therefore the tendency of the locking element 7 to jam during the movement is minimized.

If the pushbutton 80 is then released, the locking element 7 springs again against the rotation space 54 and pushes with a distal end 76 (see FIG. 11) against the cam 23, as shown in FIG. 13. As soon as the cam 23 has released the mouth region of the bolt recess 780 again on its way to the second outer rotation stop 55 and makes contact with the second outer rotation stop 55 by means of its first outer rotation stop 25, the locking element 7 can engage again in the partially annular space 54. At the same time, the pushbutton 80 migrates outward along the pin 74 and is ready for reactuation.

The locking element 7 engaging in the rotation space 54 according to FIG. 14 then positions its second locking stop 75 transversely into the partially annular space 54, and therefore the cam 23, by striking with its first inner stop 28 against the locking element 7, is blocked in the folded position according to FIG. 14.

A spacing is permitted between the stub-side end surface 76 of the locking element 7 (see FIG. 11) and the stub 21, 22, thus giving rise to a free space 77. The free space 77 permits the locking element 7 to be automatically readjusted by the spring 78 in the event of deformations of the elements occurring during use, and therefore the cam 23 is in each case held without play between the stops 58, 79 and 55, 75 in the position according to FIGS. 9 and 14. For this reason, the contact surfaces 25, 79 and 28, 75 are not precisely radial with respect to the center axis A, but rather are slightly inclined such that such a self-adjustment is possible, but the locking element 7 cannot be pushed by the cam 23 out of the locking position into the bolt recess 780 when the leg 5 is acted upon with a torque.

As can be seen from FIGS. 9 to 14, the folding leg 5 is rotatable about a center point M of the stubs 21, 22 or of the frame cross section, through which center point the pivot axis A runs.

Also in the fifth embodiment of the node 2 with the pivotable leg 5 according to FIGS. 15 to 21, the leg 5 is pivoted about the longitudinal axis of the stubs 21, 22.

In this embodiment, a locking element 7 according to a further design is presented, wherein a securing element 9 for securing the locking position is furthermore provided. In the description, reference is now made in each case to the embodiment according to FIGS. 9 to 14. Unless mentioned otherwise, the manner of operation of the elements identically denoted is identical.

A pivoting leg 5 which is set outward and has limbs 50 is again proposed here. Again, only the one limb 50 is shown and the bearing 70 is arranged between the limbs 50. The bolt recess 780 which has to be correspondingly wider because of the thicker bolt 7 is provided in the bearing 70. The stubs 21, 22 are again connected in a rotationally fixed manner to the cam 23 engaging in the rotation space 54 of the bearing 70. The inner rotation stops 28, 58, by striking against each other, define the unfolded position according to FIG. 15 in an analogous manner here, and the outer rotation stops 25, 55, by striking against each other, define the folded position according to FIG. 21 here. The locking element 7 is again prestressed by a compression spring (not illustrated) in the locking position according to FIG. 15. The compression spring here is now not accommodated under the locking element 7, as in FIGS. 9 to 14, but rather in a spring recess 781 in the locking element 7 according to FIGS. 15 to 21. The compression spring again presses with the one end against the bearing 70 and from the inside with the other end against the locking element 7 such that the latter is held in the locking position.

Figure 15:
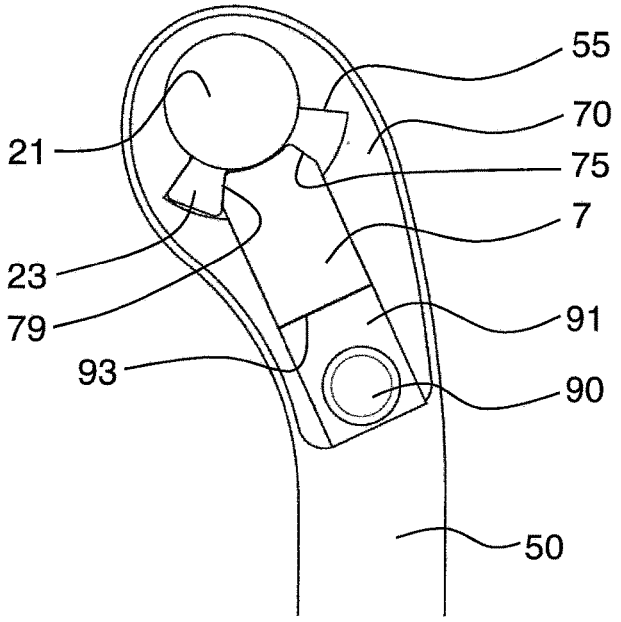
FIG. 15 shows a side view of a fifth embodiment of the node with pivotable leg, wherein the leg is blocked in an unfolded position and in a locking position by a locking element according to a second embodiment; the locking element is secured in the locking position by a securing element.
Figure 17:
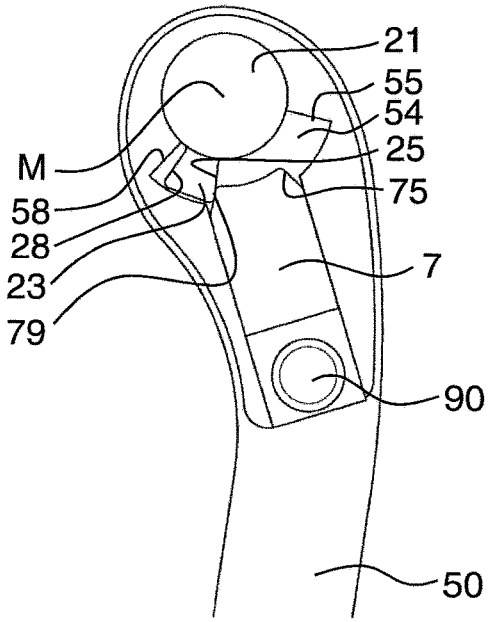
FIG. 17 shows a side view of the node with leg according to FIG. 14, wherein the leg has been pivoted to the left out of the unfolded position toward a folded position; the securing element has been pressed out of a securing position into a release position and the locking element has been pressed out of the locking position toward the release position by striking against a first locking stop on the node.
Figure 16:
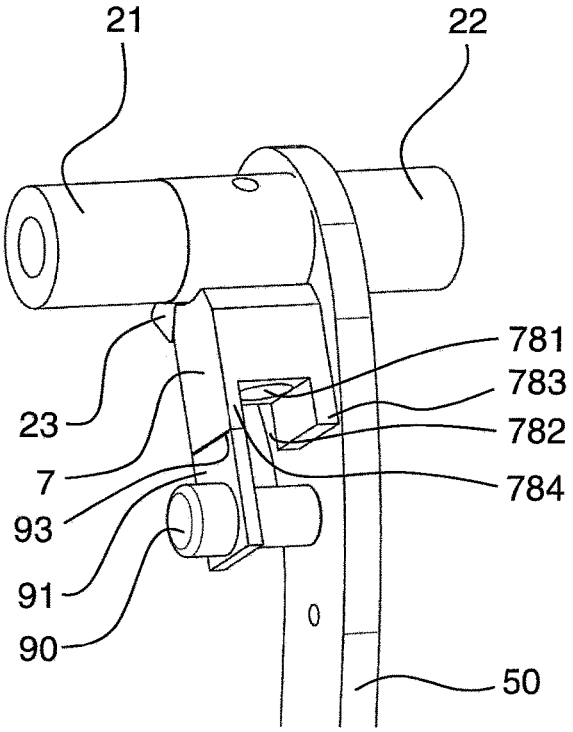
FIG. 16 shows a perspective view of the node with leg in the situation according to FIG. 15.

Owing to the thicker bolt 7, the cam 23 according to FIG. 15 is narrower than that according to FIG. 9.

The locking element 7 can again be brought into the bolt recess 780 counter to the spring force of the compression spring, and therefore the cam 23 or the leg 5 is movable between the positions according to FIGS. 15 and 21. In this embodiment, however, the contact surfaces 25, 79 and 28, 75 are now greatly inclined with respect to the radial direction such that, by manual pivoting as intended of the leg 5, the cam 23 is capable of building up a transverse force counter to the compression direction of the compression spring, and therefore the leg 5 can thus be pivoted as a lever without a pushbutton 80 within the meaning of FIGS. 9 to 14.

In order now to prevent inadvertent erroneous manipulation of the folding mechanism, a securing element 9 is provided. Said securing element 9 again comprises a pushbutton (here 90) which protrudes to the one side through the limb 50 (not illustrated) and is thus actuable from the outside and acts to the other side on a securing plate 91. The pushbutton 90 is prestressed in the position according to FIG. 15 by a further compression spring and can be pressed in the A direction toward the other limb 50, and therefore the plate 91 is displaceable toward the center of the leg.

A recess 782 is provided at the stub-remote end of the locking element 7, at the point where the mouth into the compression spring opening 781 is located. As can be seen from FIGS. 16 and 18, two further bolt limbs 783, 784 therefore protrude to the side of the mouth of the compression spring recess 781 in the vicinity of the limb, said bolt limbs bounding the recess 782 on the limb side. The bolt limb 783 in the vicinity of the pushbutton now interacts by means of its free end surface as second securing stop 785 with a first securing stop 93, which is directed counter to the locking element 7, on the securing plate 91. If the securing plate 91 is in the securing position according to FIG. 15, the locking element 7 is lined up in the locking position with the securing plate 91. The locking element 7 therefore cannot be displaced and the unfolded position according to FIG. 15 is secured.

Figure 18:
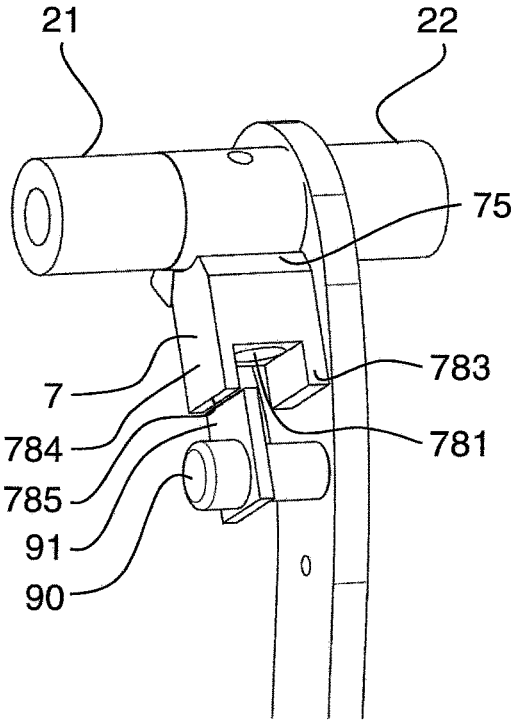
FIG. 18 shows a perspective view of the node with leg in the situation according to FIG. 17.

If, however, the pushbutton 90 is now pushed in from the outside, the securing plate 91 is displaced toward the center of the leg, as shown in FIG. 18, the mutual striking together of the first and second securing stops 93, 785 is eliminated and, by pivoting of the leg 5 counter to the position according to FIG. 21, the locking element 7 can be brought via the intermediate position according to FIG. 19 into the folded position according to FIG. 21. The securing plate 91 then engages here in the recess 782, and therefore the locking element 7 is provided with the required movement space.

The embodiment according to FIGS. 9 to 14 can likewise be equipped with a further securing means within the meaning of the embodiment according to FIGS. 15 to 21.

So that the securing and operating function can be undertaken single-handedly in this embodiment too, the leg 5 then has two pushbuttons 80, 90 (one each in the upper region of the two limbs 50). The pushbutton 80 on the one side actuates the pulling-back of the locking element 7, the button 90 on the other side detaches the securing mechanism from the first securing stop 93 and therefore releases the pulling-back option.

So that the linkage of the functions operates seamlessly and the user can intuitively operate said functions, it is advantageous if the following boundary conditions are maintained:

When both buttons are pressed simultaneously with thumb and index finger, the one button 90 (securing component) immediately pushes the blocking bolt 91 out of the sliding region of the locking element 7 by means of the first securing stop 93. A pressing distance of approximately 2 millimeters to 3 millimeters should suffice here. In the case of the movement button 80 (movement component) on the other side of the leg 5, the first 2 millimeters to 3 millimeters pressing distance are preferably a "freewheel"—i.e. the control curve 81 is designed in such a manner that the locking element 7 is still not displaced over the freewheeling distance. The user will reflexively push in both buttons simultaneously with the same force. When the securing button 90 is pressed in, the securing means 9 is pushed out of the blocking position. As the two buttons 80, 90 are pressed in deeper, the locking element 7 is pushed with the aid of the control curve 81 on the movement button 80 out of the two possible retaining positions in such a manner that the leg 5 is movable into the desired new position (unfolded for use or folded for putting away).

As soon as the two buttons 80, 90 are no longer pressed in, the buttons 80, 90 and those elements of the control and securing mechanism which are connected to said buttons automatically move back into their starting position because of the action of appropriately placed compression springs. In order to provide the required resetting force, the two buttons/systems are therefore provided with smooth-running compression springs.

In another development, an insert 500 can be placed into the bolt recess 780, in which the locking element 7 moves, which optimizes the movement of the locking element 7 in the bolt recess 780. The sliding resistance and the abrasion of the locking element 7 can be reduced, for example, by an insert plate or a sliding band, wherein the insert at least partially lines the bolt recess 780. The insert 500 preferably covers the base of the bolt recess 780. However, it is also conceivable for the insert 500 to line the entire bolt recess 780 or only the walls thereof but not the base.

FIGS. 27 and 28 illustrate preferred embodiments of the insert 500. For the sake of clarity, the leg limbs 50 have been illustrated by broken lines and FIGS. 27, 28 show the insert 500 in the fitted position in said leg limb 50.

The insert 500 according to FIG. 27 is placed into the bolt recess 780, in which recess the locking element 7 is moved. Said insert 500 can be manufactured from metal, in particular hardened metal, for example from a sliding band made of hardened metal, or from plastic, and, as illustrated in FIGS. 27 and 28, can be placed into the channel 780, in a manner making contact with the narrow side of the locking element 7, i.e. lying on the bottom side in the channel 780.

In a development, an extension 786 can be provided in the lower region of the channel 780, which extension is also provided as a thickened portion 501 in the case of the insert 500, and therefore a form-fitting connection is realized between the thickened portion 501 of the insert 500 and the leg limb 50, and it is therefore prevented that the insert 500 moves during displacement of the locking element 7. This is illustrated by way of example in FIG. 27.

The insert 500 according to the embodiment according to FIG. 27 merely extends in the channel 780. In a development according to FIG. 28, said insert 500 can extend with first portions 502 into the partially annular space 54 and can be provided there for making contact with the axial surfaces of the cam 23.

In another development, the insert 500 can have second portions 503 which adjoin the first portions 502 and limit the partially annular space 54 in the circumferential direction and thus form the rotation stops 55, 58 for the cam 23, as shown in FIG. 28. As a result, particularly robust rotation stops 55, 58 are provided, which prevents premature wear.

In another development, the insert 500 can extend with a further third portion 504, as illustrated in FIG. 28, into the recess in the leg limb 50 for receiving the node 2. The third portion 504 preferably connects the first portions 502. It is particularly preferred if the insert 500, by means of the first and third portions 502, 504, completely lines the recess in the leg limb 5 such that the node 2 is completely surrounded by the insert 500. Depending on the embodiment, the insert 500 can then rest on the layer of material 211.

Therefore, preferably the locking element 7, particularly preferably also the cam 23 and advantageously also the node 2 (or the stubs 21, 22) are each guided on the insert 500 during the unfolding or folding of the folding leg 5.

By means of the insert 500, sliding properties and wear properties of the folding leg 5 are optimized.

Figure 29:
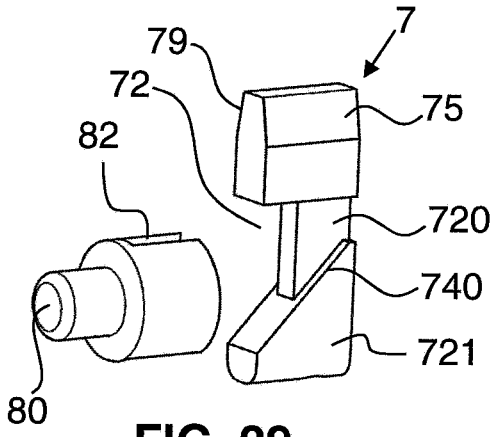
FIG. 29 shows, in a perspective view, a further embodiment of the locking element with pushbutton.
Figure 30:
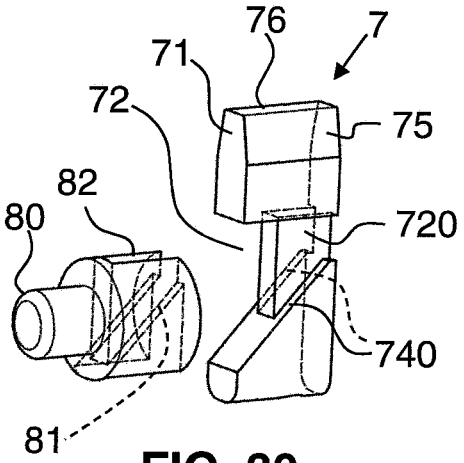
FIG. 30 shows the subject matter according to FIG. 29, wherein some of the concealed edges have been made visible (by dashed lines)

FIGS. 29 and 30 show a further embodiment of the locking element 7 and of the pushbutton 80. The locking element 7 again has a tapering end portion 71 with the oblique stop surfaces 75, 79. The recess 72 into which the pushbutton 80 can be pressed counter to spring force is present centrally in the longitudinal direction in the locking element 7.

The body of the locking element 7 is of thinner design in the region of the recess 72. Said thin region 720 is designed in such a manner that an obliquely running supporting surface 740 is provided on both sides of the locking element 7, said supporting surface interacting with an oblique mating surface 81 of the pushbutton 80 (see FIGS. 29, 30) in such a manner that the movement of the pushbutton 80, which movement runs transversely with respect to the longitudinal direction of the leg 5, is deflected into a movement of the locking element 7, which movement runs along the leg 5. As shown in FIG. 29, the oblique supporting surface 740 therefore constitutes a ramp or an oblique sliding surface, along which the pushbutton 80 guided linearly in and out of the recess 72 runs and thus moves the locking element 7 over the oblique surface 740 in the longitudinal direction of the leg 5, as has been described in conjunction with FIGS. 10 and 12.

For this purpose, the pushbutton 80 has a slotted recess 82 in which the mating surfaces 81 are incorporated. In this connection, reference is made to FIG. 30. That portion of the slot 82 which is located at the top in FIG. 30 is of a width such that the pushbutton 80 nestles closely against the thin region 720 on both sides, wherein that portion of the slot 82 which is located at the bottom in FIG. 30 is expanded via a step 81 in such a manner that said lower part of the slot 82 can be pushed over the lower thick region 721 of the locking element 7. As can be seen in FIG. 30, the flat oblique surface 81 comes to lie on the ramp-like supporting surface 740 of mirror-inverted shape during the linear displacement of the pushbutton 80 over the locking element 7, which brings about said deflection of the movement.

Figure 31:
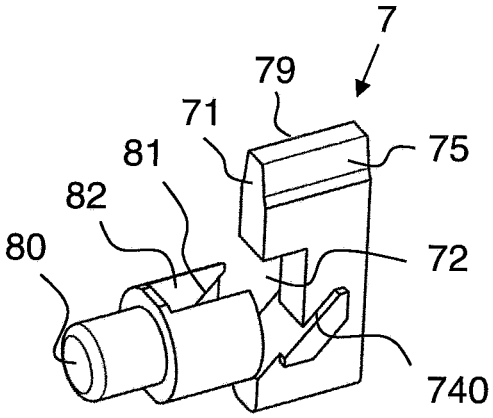
FIG. 31 shows, in a perspective view, a further embodiment of the locking element with pushbutton.
Figure 32:
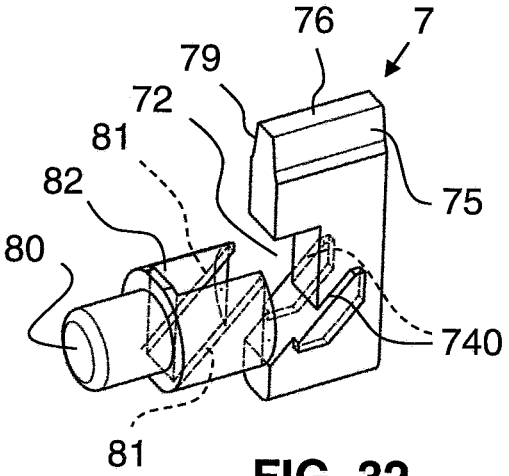
FIG. 32 shows the subject matter according to FIG. 31, wherein some of the concealed edges have been made visible (by dashed lines).

FIGS. 31 and 32 show a further embodiment of the locking element 7 and of the pushbutton 80. The locking element 7 is again provided with a recess 72, wherein a thin region 720 is no longer now provided centrally, as in FIGS. 29 and 30, but rather the ramp 740 is formed or placed onto the locking element 7 laterally and on both sides. Accordingly, that part of the slot 82 of the pushbutton 80 that is located at the top in the figures is of such a wide design that said slotted portion can be pushed over the locking element 72 in the depth of the recess 72. The slot 82 in the pushbutton 80 according to the embodiment according to FIGS. 31 and 32 is therefore wider at least in the upper region than the slot which is shown in FIGS. 29 and 30. The lower part of the slot 82 of the pushbutton 80 according to FIGS. 31 and 32 is again of wider design than the upper part, thus producing a step 81 which is formed in a mirror-inverted manner with respect to the ramp 740, and therefore the pushbutton 80 runs up onto the ramp 740 during the linear displacement.

In both embodiments according to FIGS. 29-32, the pushbutton 80 and the locking element 7 are designed in such a manner that, during the linear displacement of the pushbutton 80 counter to the locking element 7, the latter is pressed away downward. Again, springs 78, as shown in FIGS. 9-14, can be used in order, after release of the pushbutton 80, to reset the locking element 7 by pushing back the pushbutton 80 counter to the cam 23.

It is advantageous in the embodiments according to FIGS. 29-32 that a flat contact is formed between the pushbutton 80 and the mating surface 740 of the locking element 7, and therefore the conversion of movement from a horizontal movement of the pushbutton 80 into a vertical movement of the locking element 7 is converted via an oblique sliding path. The flat contact which is enlarged in comparison to the embodiment according to FIGS. 10 and 12 leads to a lower stressing of the contact surfaces. In addition, the contact between the pushbutton 80 and the locking element 7 is better defined.

LIST OF REFERENCE SIGNS

| | |
|---|---|
| 1 | Frame structure |
| 10 | Frame |
| 2 | Node |
| 20 | Node body |
| 21, 22 | Projection, stub |
| 211 | Hat |
| 23 | Cam |
| 230 | Cap |
| 25 | First outer rotation stop or first locking stop on 2 |
| 28 | First inner rotation stop on 2 |
| 4 | Internode |
| 41, 42 | End portion of 4 |
| 43 | Recess in 41 |
| 430 | Contact surface of 41 |
| 44 | Adapter piece |
| 45 | Cutout in 44 |
| 5 | Leg |
| 50 | Leg limb |
| 500 | Insert part |
| 501 | Thickened portion |
| 502 | First portion of 500 |
| 503 | Second portion of 500 |
| 504 | Third portion of 500 |
| 54 | Rotation recess |
| 55 | Second outer rotation stop |
| 58 | Second inner rotation stop |
| 59 | O-ring |
| 6 | Fastening device |
| 61 | First part of 6 |
| 62 | Second part of 6 |
| 64 | Conical portion |
| 640 | Free end of 64 |
| 641 | Engagement recess in 640 |
| 642 | Offset |
| 66 | Depression for 64 |
| 67 | Engagement element |
| 670 | End surface |
| 7 | Locking element |
| 70 | Bearing |
| 71 | Tapering end portion |
| 72 | Recess in 7 |
| 720 | Central thin region |
| 721 | Proximal thick region |
| 73 | Second securing stop on 71 |
| 74 | Pin |
| 740 | Flat oblique surface, ramp |
| 75 | First locking stop |
| 76 | Distal end side of 7 |
| 77 | Free space |
| 78 | Compression spring for 7 |
| 780 | Bolt recess for 7 |
| 781 | Spring recess |
| 782 | Recess for 91 |
| 783 | Bolt limb of 7 |
| 784 | Bolt limb of 7 |
| 785 | Second securing stop |
| 786 | Enlarged recess, extension |
| 79 | Second locking stop on 7 |
| 8 | Actuating element |
| 80 | Pushbutton |
| 81 | Control curve |
| 82 | Slot |
| 9 | Securing element |
| 93 | First securing stop on 9 |
| A | Pivot axis |
| $D_I$ | Max. diameter of 4 |
| $D_N$ | Max. diameter of 2 |
| $D_R$ | Max. diameter of 10 |
| H | Main plane of 10 |
| M | Cross section center point of 10 |

The invention claimed is:

1. A frame structure for a mini trampoline, wherein the frame structure comprises at least three nodes, at least three elongate internodes and a plurality of legs, wherein two of the internodes are rigidly connected to each other via one of the nodes such that a closed frame lying substantially in a main plane is formed, and wherein each leg is fastened directly to one of the nodes, wherein all of the nodes are configured as wide leg nodes and extend outwardly in a deformed manner from the frame structure parallel to the main plane such that the legs are set outward with respect to the frame, and wherein the nodes are provided with a first part of a fastening device and the legs are provided with a second part of the fastening device for fastening one of the legs to one of the nodes, wherein the fastening device is configured in such a manner that a connecting axis of the fastening device, along which said leg and node are connectable, runs substantially perpendicular to the main plane.

2. The frame structure as claimed in claim 1, wherein a maximum inside diameter of the frame structure in the main plane lies within a range from 80 centimeters to 200 centimeters, or wherein a length of the legs perpendicular to the main plane lies within a range from 15 centimeters to 35 centimeters, or wherein dimensions and materials of the frame structure are selected in such a manner that a weight of the frame structure is less than 18 kilograms or less than 16 kilograms or less than 15 kilograms.

3. The frame structure as claimed in claim 1, wherein the fastening device comprises an engagement connection, and one of the first or second parts of the fastening device comprises a distally tapering conical portion with a free end and the other of the first or second parts comprises a corresponding, conically outwardly expanding depression, wherein an engagement recess is embedded in the free end of the conical portion, and an engagement element corresponding to the engagement recess is arranged in the depression.

4. The frame structure as claimed in claim 3, wherein the engagement element is completely recessed in the depression.

5. The frame structure as claimed in claim 1, wherein each node has two projections which protrude in opposite directions, along the main plane, wherein end portions of the internodes are each provided with a recess, wherein said recesses are configured to receive said projections in a precisely fitting manner.

6. The frame structure as claimed in claim 5, wherein said projections are cylindrical and one of rectilinear and arcuate.

7. The frame structure as claimed in claim 5, wherein each projection engages with flat contact over at least a maximum frame thickness or over at least 2 centimeters in the corresponding internode.

8. The frame structure as claimed in claim 5, wherein adapter pieces are configured to be introduced in the recesses in said end portions, said adapter pieces including cutouts for precisely fitting and accommodating the projections of the respective nodes therein.

9. The frame structure as claimed in claim 1, wherein all of the legs are mounted on a respective node so as to be pivotable along a pivoting movement about a pivot axis between an unfolded position and a folded position, wherein each node has a first outer rotation stop and each leg has a corresponding second outer rotation stop, wherein the first and second outer rotation stops define the unfolded position of the leg.

10. The frame structure as claimed in claim 9, wherein the pivot axis of the pivotable leg runs through a frame cross section center point.

11. The frame structure as claimed in claim 9, further comprising a locking element, wherein said locking element is mounted on the respective leg or on the respective node so as to be displaceable along a locking movement running substantially perpendicularly to the pivot axis, between a release position and a locking position, wherein, in the locking position, the locking element blocks the pivoting movement and, in the release position, releases the pivoting movement.

12. The frame structure as claimed in claim 11, wherein the locking element is held in the locking position under prestress, wherein a first locking stop is arranged on the respective node, wherein a second locking stop is arranged on the locking element, wherein a contact surface between the first and the second locking stop is substantially parallel to the locking movement, and wherein an actuating element which is actuable manually from outside is provided, wherein said actuating element, upon actuation, transfers the locking element from the locking position into the release position.

13. The frame structure as claimed in claim 12, further comprising a securing element, wherein a first securing stop is provided on the locking element and a second securing stop is provided on the securing element, wherein the securing element is movable along a securing movement between a securing position and a release position, wherein, when the securing element is in the securing position, the first securing stop lines up with the second securing stop in the locking movement in such a manner that the locking element is blocked in the locking position, and wherein the securing element is movable manually from the outside into the release position, and therefore the locking element is released.

14. The frame structure as claimed in claim 11, wherein a first locking stop is arranged on the respective node, wherein a second locking stop is arranged on the locking element, wherein a contact surface between the first and the second locking stop is arranged at such an angle to the locking movement that the locking element can be pressed out of the locking position into the release position by manual pivoting of the leg.

15. The frame structure as claimed in claim 11, where a free end of the locking element is configured with a tapering conical portion.

16. The frame structure as claimed in claim 9, wherein the respective node has a first inner rotation stop and the respective leg has a corresponding second inner rotation stop, wherein the first and second inner rotation stops define the folded position of the leg.

17. A mini trampoline with a frame structure as claimed in claim 1, furthermore comprising a rebounding mat which is stretched onto the frame.

* * * * *